US005203325A

United States Patent [19]

Carr

[11] Patent Number: 5,203,325

[45] Date of Patent: Apr. 20, 1993

[54] SELF CONTAINED APPARATUS FOR INDEFINITE RESPIRATION IN NON-AIR ENVIRONMENTS

[76] Inventor: Jonathan A. Carr, 1418 Hopkins St. NW., Washington, D.C. 20036

[21] Appl. No.: 857,991

[22] Filed: Mar. 26, 1992

[51] Int. Cl.[5] ..... B63C 11/20

[52] U.S. Cl. ..... 128/202.26; 128/202.23; 128/205.22

[58] Field of Search ..... 128/200.24, 202.26, 128/202.23, 205.22, 201.25, 205.12, 205.28, 205.24, 201.11, 200.25, 201.27, 201.28, 201.29, 202.14, 202.19

[56] References Cited

U.S. PATENT DOCUMENTS

| | | | |
|---|---|---|---|
| 2,456,130 | 12/1948 | Lambertsen | 128/205.22 |
| 3,504,669 | 4/1970 | Albert | 128/202.26 |
| 3,575,167 | 4/1971 | Michielsen | 128/205.28 |
| 3,971,372 | 7/1976 | Lenk et al. | 204/129 |
| 4,752,263 | 6/1988 | Pritchard et al. | 128/202.14 |
| 4,964,404 | 10/1990 | Stone | 128/205.22 |

*Primary Examiner*—David A. Wiecking
*Assistant Examiner*—Lynn D. Hendrickson
*Attorney, Agent, or Firm*—Michael I. Kroll

[57] ABSTRACT

A self contained apparatus for indefinite respiration in non-air environments is provided and consists of a vest pack having a front section, a pair of flexible shoulder bars and a back section which is worn by a diver. A mechanism is for securing the front section and the back section of the vest pack about the waist of the diver. Water is stored in the back section of the vest pack. An air hose extends from the top of the flexible shoulder bars of the vest pack. A mouthpiece is connected to the air hose and another mechanism is within the vest pack, for electrolyzing the water in the back section so as to release the oxygen and allow the diver to breath the oxygen through the mouthpiece.

6 Claims, 3 Drawing Sheets

Fig. 9
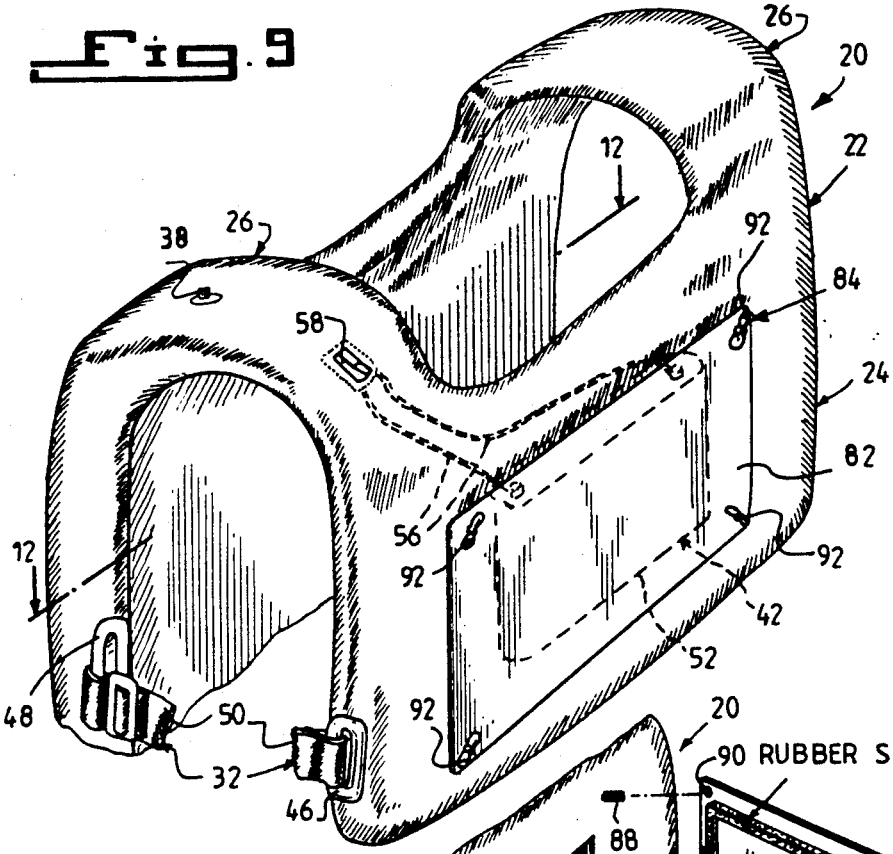
Fig. 10
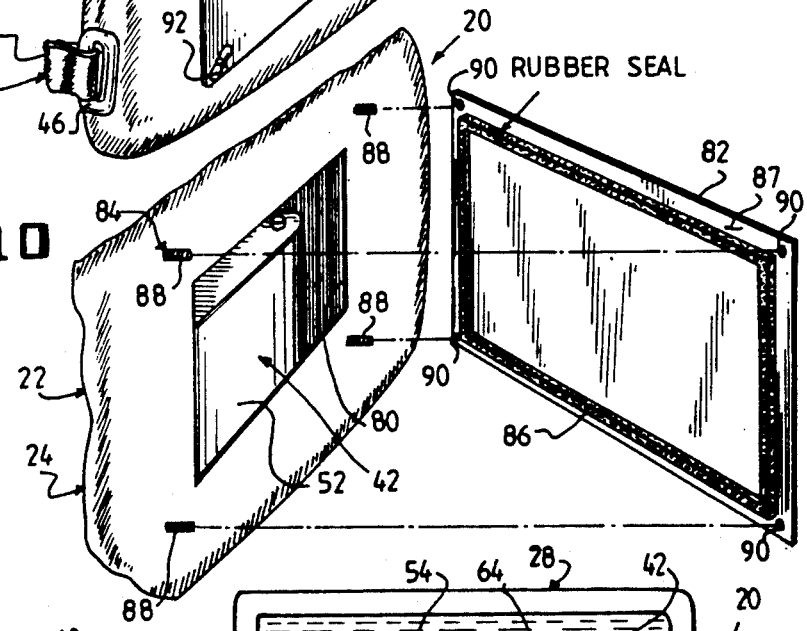
Fig. 11
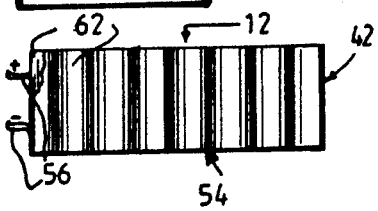
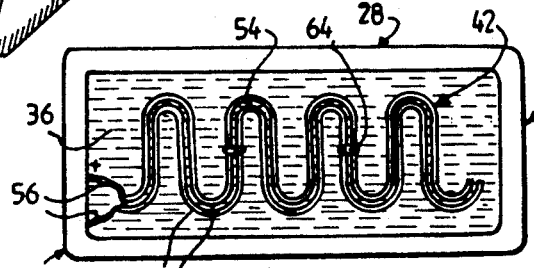
Fig. 12

SELF CONTAINED APPARATUS FOR INDEFINITE RESPIRATION IN NON-AIR ENVIRONMENTS

BACKGROUND OF THE INVENTION

1. Field of the Invention

The instant invention relates generally to scuba equipment and more specifically it relates to a self contained apparatus for indefinite respiration in non-air environments.

2. Description of the Prior Art

Numerous scuba equipment have been provided in prior art that are adapted to allow divers to breath compressed air from tanks underwater for short periods of time. While these units may be suitable for the particular purpose to which they address, they would not be as suitable for the purposes of the present invention as heretofore described.

SUMMARY OF THE INVENTION

A primary object of the present invention is to provide a self contained apparatus for indefinite respiration in non-air environments that will overcome the shortcomings of the prior art devices.

Another object is to provide a self contained apparatus for indefinite respiration in non-air environments that is a vest pack worn on a diver to liberate oxygen from stored water by a battery electrolyzing the water so that the diver may breath.

An additional object is to provide a self contained apparatus for indefinite respiration in non-air environments in which the diver may breath the liberated oxygen during a long term submersion as long as the battery will electrolyze the stored water carried in the vest pack worn on the diver.

A further object is to provide a self contained apparatus for indefinite respiration in non-air environments that is simple and easy to use.

A still further object is to provide a self contained apparatus for indefinite respiration in non-air environments that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 9 is a front perspective view similar to FIG. 2 of a modification showing an air-tight sealed door for the front section of the vest pack.

FIG. 10 is a front perspective view of a portion of the front section of the vest pack of FIG. 9, showing the door removed therefrom.

FIG. 11 is an elevational view of the electrolyzer member used in the compartment in the rear section of the vest pack in FIG. 9.

FIG. 12 is a diagrammatic cross sectional view taken along line 12—12 in FIG. 9, showing a top view of the electrolyzer member as indicated by arrow 12 in FIG. 11.

DETAILED DESCRIPTION OF THE PREFERRED EMBODIMENTS

Figure 1:
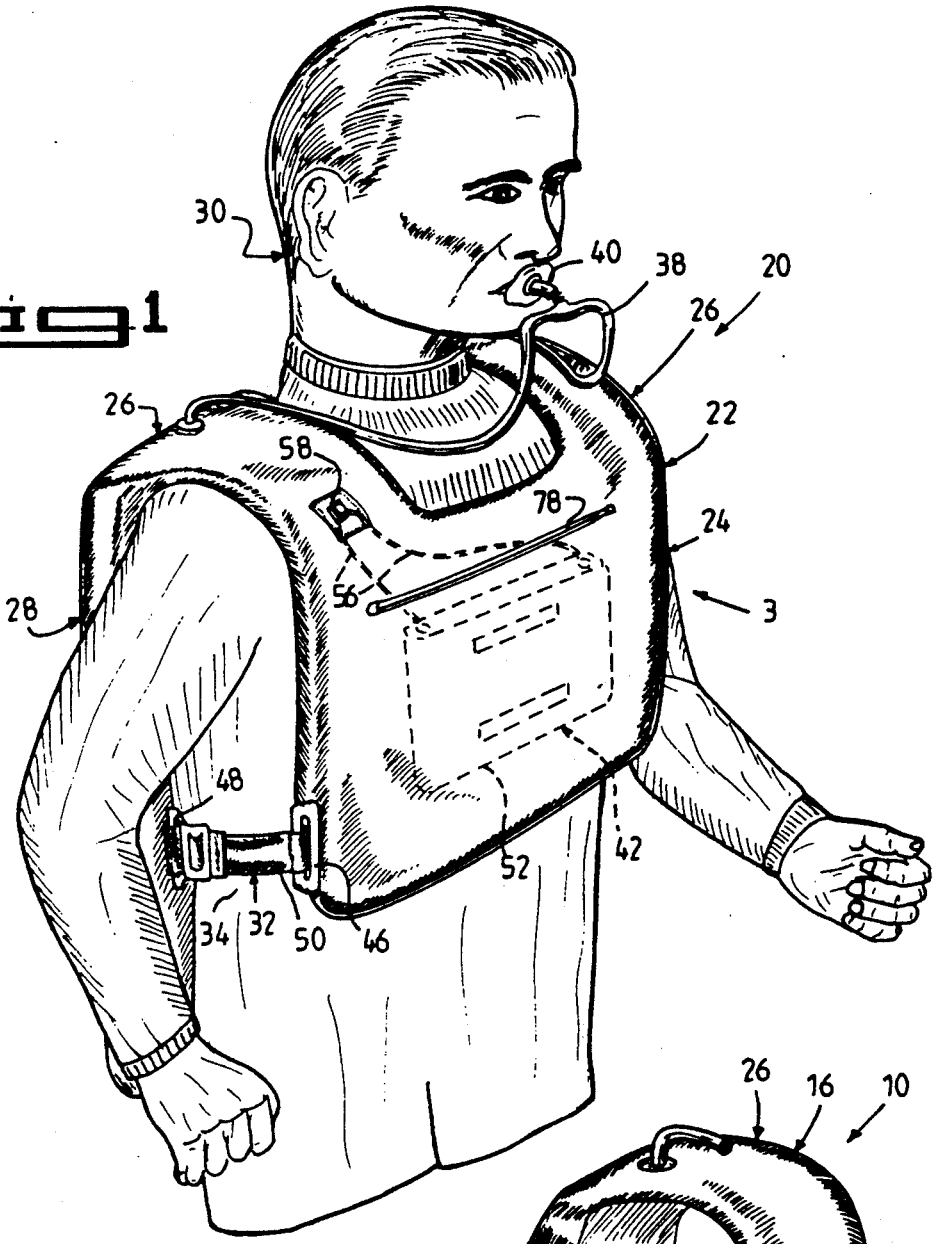
FIG. 1 is a front perspective view of the instant invention worn on a diver breathing from the apparatus.

Turning now descriptively to the drawings, in which similar reference characters denote similar elements throughout the several views, the Figures illustrate a self contained apparatus 20 for indefinite respiration in non-air environments consisting of a vest pack 22, having a front section 24, a pair of flexible shoulder bars 26 and a back section 28 which is worn by a diver 30. A mechanism 32 is for securing the front section 24 and the back section 28 of the vest pack 22 about the waist 34 of the diver 30. Water 36 is stored in the back section 28 of the vest pack 22. An air hose 38 extends from the top of the flexible shoulder bars 26 of the vest pack 22, while a mouthpiece 40 is connected to the air hose 38. Another mechanism 42 within the vest pack 22 is for electrolyzing the water 36 in the back section 28 so as to release the oxygen 44 and allow the diver 30 to breath the oxygen 44 through the mouthpiece.

The securing mechanism 32 includes a first pair of elongated eyelets 46, each positioned at a lower corner of the front section 24 of the vest pack 22. A second pair of elongated eyelets 48 are provided, with each positioned at one side of the back section 28 in alignment with one of the first pair of elongated eyelets 46. A pair of belts 50, are also provided with each extending between one of the first pair of elongated eyelets 46 and the second pair of elongated eyelets 48 at the waist 34 of the diver 30.

The electrolyzing mechanism 42 includes a battery 52 carried in the front section 24 of the vest pack 22. An electrolyzer member 54 is carried in the back section 28 of the vest pack 22 within the stored water 36 and a pair of wires 56, extending from the battery 52 to the electrolyzer member 54 so that the electrolyzer member 54 can be charged by the battery 52 to electrolyze the water 36 and release the oxygen 44 therefrom.

The electrolyzing mechanism 42 further includes a waterproof switch 58 carried on one of the flexible shoulder bars 26 and is electrically connected to the wires 56 so that the switch 58 can be manually operated by the diver 30 to turn the current to the electrolyzer member 54 on and off.

A plurality of one way valves 60 are at the bottom of the back section 28 of the vest pack 22 to allow more water 36 to enter when the diver 30 breaths the oxygen 44 out of the back section 28 and to prevent the oxygen 44 to escape when the diver 30 is diving deeper.

The electrolyzer member 54 includes a pair of highly conductive wavy metal plates 62, each connected to one of the wires 56 extending from the battery 52. A plurality of non-conductive clips 64 keep the metal plates 62 in place and very close together.

Each one way valve 60 includes a conduit 66 having a narrow segment 68 extending from the exterior of the back section 28 into a water segment 70 extending into the interior where the water 36 is stored. A rubber ball 72 is movable in the wider segment 70 of the conduit 66 so as to seal off the narrow segment 68 of the conduit 66 when the diver 30 is diving. A first screen 74 cover the narrow segment 68 of the conduit on the exterior of the back portion 28. A second screen 76 covers the wider segment 70 of the conduit 66 on the interior of the back portion 28.

Figure 2:
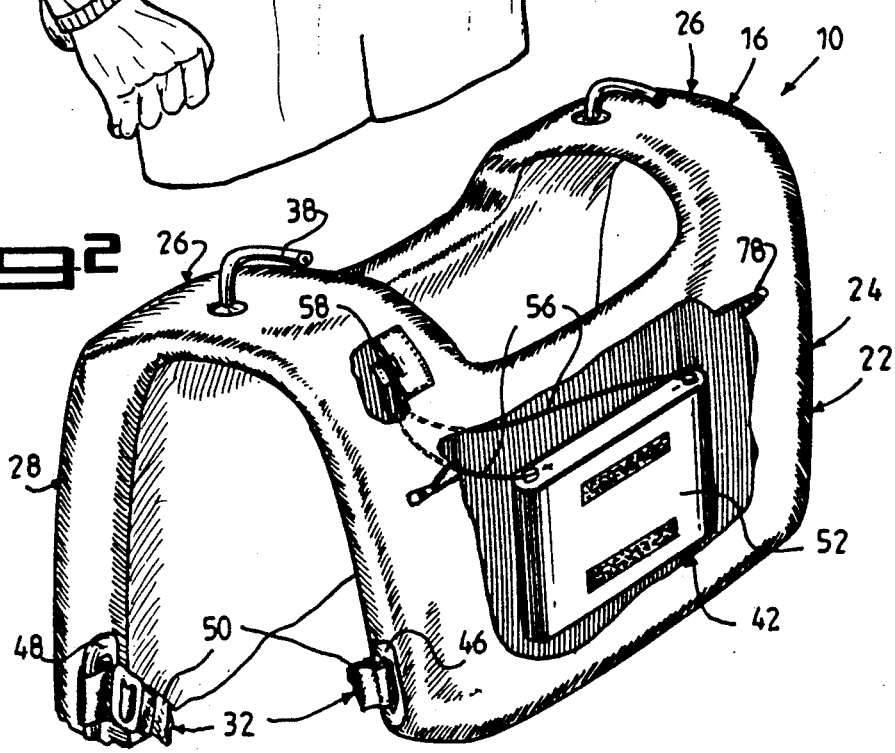
FIG. 2 is a front perspective view of the instant invention per se with parts broken away.
Figure 3:
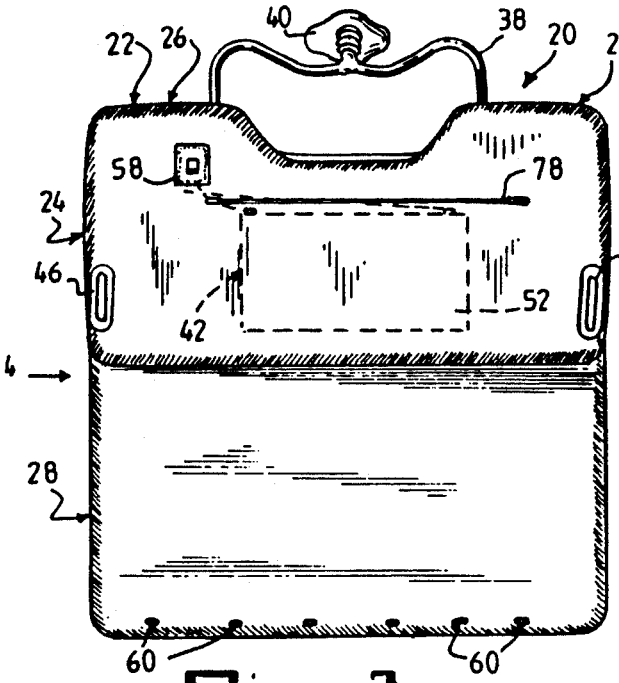
FIG. 3 is a front view taken in direction of arrow 3 in FIG. 1.
Figure 4:
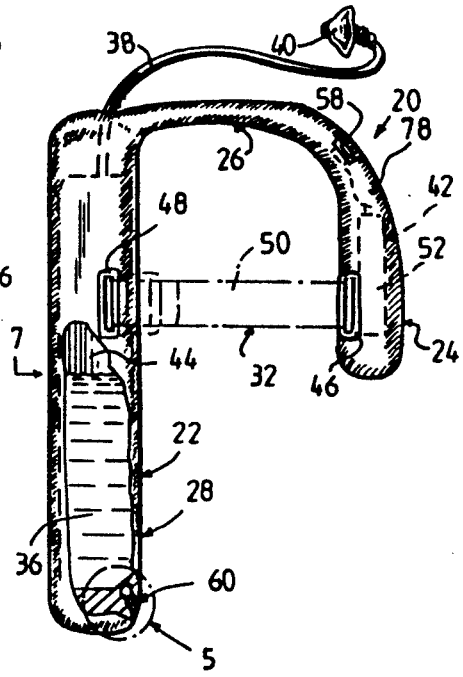
FIG. 4 is a side view taken in direction of arrow 4 in FIG. 3 with parts broken away.
Figure 5:
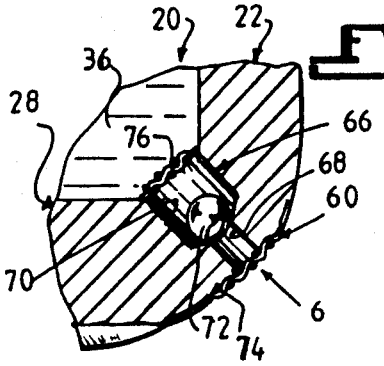
FIG. 5 is an enlarged cross sectional view as indicated by arrow 5 in FIG. 4, showing one one-way valve in greater detail.
Figure 8:
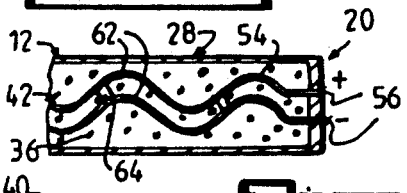
FIG. 8 is a cross sectional view taken along line 8—8 in FIG. 7.
Figure 6:
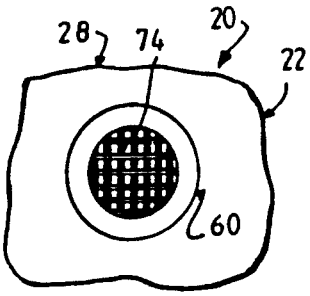
FIG. 6 is a view taken in direction of arrow 6 in FIG. 5.
Figure 7:
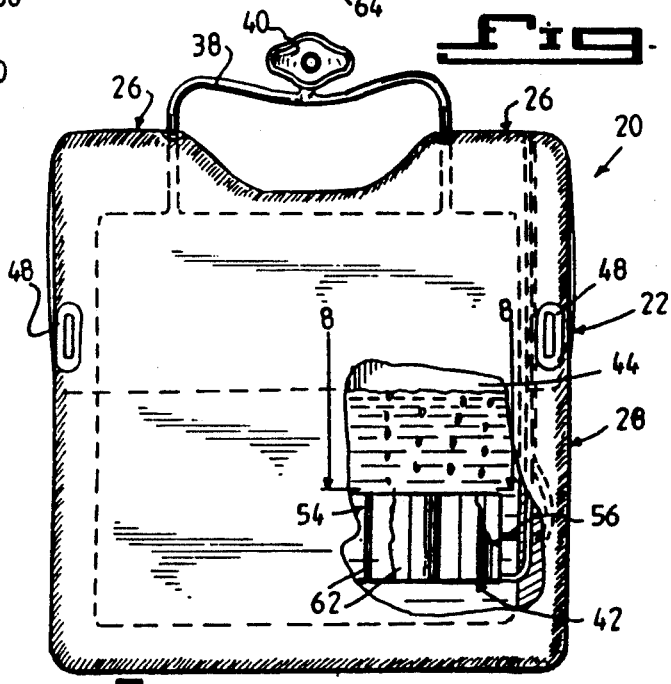
FIG. 7 is a rear view taken in direction of arrow 7 in FIG. 4 with parts broken away.

As shown in FIGS. 1 through 4, the front section 24 of the vest pack 22 includes an air tight waterproof ZIPPER 78 so that the battery 52 can be inserted therein and electrically connected to the pair of wires 56.

As shown in FIGS. 9 and 10, the vest pack 22 includes the front section 24 having a enlarged aperture 80 so that the battery 52 can be inserted therein and electrically connected to the pair of wires 56. A door 82 is sized to fit over the enlarged aperture 80 in the front section 24 of the vest pack 22. Mechanism 84 is for affixing the door 82 in an air tight waterproof seal to the front section 24 of the vest pack 22. The affixing mechanism 84 includes a rubber seal 86 attached to the back 87 of the door 82. Four threaded shafts 88 are on the front section 24 of the vest pack 22 and positioned so that each shaft 88 can extend through one corner 90 of the door 82. A wing nut 92 is threaded onto each of the threaded shafts 88 so that when the wing nuts 92 are tightened the rubber seal 86 will prevent water 36 to enter and air to exit from the enlarged aperture 80.

LIST OF REFERENCE NUMBERS

20 a self contained apparatus
22 vest pack
24 front section
26 shoulder bar
28 back section
30 diver
32 securing mechanism
34 waist of 30
36 water
38 air hose
40 mouthpiece
42 electrolyzing mechanism
44 oxygen
46 elongated eyelet
48 elongated eyelet
50 belt
52 battery
54 electrolyzer member
56 wire
58 waterproof switch
60 one way valve
62 highly conductive wavy metal plate
64 non-conductive clip
66 conduit
68 narrow segment in 66
70 wider segment in 66
72 rubber ball
74 first screen
76 second screen
78 air tight waterproof ZIPPER in 24
80 enlarged aperture in 24
82 door
84 affixing mechanism
86 rubber seal
87 back of 82
88 threaded shaft
90 corner of 82
92 wing nut It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A self contained apparatus for indefinite respiration in non-air environments which comprises:

a vest pack having a front section, a pair of flexible shoulder bars having a top and a back section which is worn by a diver;

means for securing the front section and the back section of said vest pack about the waist of the diver, said securing means including a first pair of elongated eyelets, each positioned at a lower corner of the front section of said vest pack, a second pair of elongated eyelets, each positioned at one side of the back section in alignment with one of said first pair of elongated eyelets, and a pair of belts, each extending between one of said first pair of elongated eyelets and said second pair of elongated eyelets at the waist of the diver;

water stored in the back section of said vest pack;

an air hose extending from the top of the flexible shoulder bars of said vest pack;

a mouthpiece connected to said air hose;

means within said vest pack, for electrolyzing the water in the back section so as to release the oxygen and allow the diver to breath the oxygen through said mouthpiece, said electrolyzing means including a battery carried in the front section of said vest pack, an electrolyzer member carried in the back section of said vest pack within the stored water, a pair of wires extending from said battery to said electrolyzer member so that said electrolyzer member can be charged by said battery to electrolyze the water and release the oxygen therefrom, a waterproof switch carried on one of the flexible shoulder bars and electrically connected to said wires so that said switch can be manually operated by the diver to turn the current to said electrolyzer member on and off;

a plurality of one way valves at the bottom of the back section of said vest pack to allow more water to enter when the diver breaths the oxygen out of the back section and to prevent the oxygen from escaping when the diver is diving deeper.

2. A self contained apparatus as recited in claim 1, wherein said electrolyzer member includes:

a) a pair of highly conductive wavy metal plates, each connected to one of said wires extending from said battery; and b) a plurality of non-conductive clips that keep said metal plates in place and very close together.

3. A self contained apparatus as recited in claim 2, wherein each said one way valve includes:

a) a conduit having a narrow segment extending from the exterior of back section into a water segment extending into the interior where the water is stored;

b) a rubber ball movable in the wider segment of said conduit so as to seal off the narrow segment of said conduit when the diver is diving;

c) a first screen to cover the narrow segment of said conduit on the exterior of said back portion; and d) a second screen to cover the wide segment of said conduit on the interior of said back portion.

4. A self contained apparatus as recited in claim 3, wherein the front section of said vest pack includes an air tight waterproof ZIPPER so that said battery can be inserted therein and electrically connected to said pair of wires.

5. A self contained apparatus as recited in claim 3, wherein said vest pack includes:

a) the front section having an enlarged aperture so that said battery can be inserted therein and electrically connected to said pair of wires;

b) a door sized to fit over the enlarged aperture in the front section of said vest pack;

c) means for affixing said door in an air tight waterproof seal to the front section of said vest pack.

6. A self contained apparatus as recited in claim 5, wherein said affixing means includes:

a) a rubber seal attached to the back of said door;

b) four threaded shafts on the front section of said vest pack and positioned so that each said shaft can extend through one corner of said door; and c) four wing nuts, each threadable onto one of said threaded shafts so that when said wing nuts are tightened said rubber seal will prevent water to enter and air to exit from the enlarged aperture.

* * * * *